US010098420B2

(12) United States Patent
Asami et al.

(10) Patent No.: US 10,098,420 B2
(45) Date of Patent: Oct. 16, 2018

(54) FASTENER ELEMENT AND METHOD FOR PRODUCING SAME

(71) Applicant: YKK Corporation, Tokyo (JP)

(72) Inventors: Toshiyuki Asami, Toyama (JP); Isamu Michihata, Toyama (JP); Sayaka Nakamura, Toyama (JP); Yoshinori Kojima, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/520,741

(22) PCT Filed: Oct. 29, 2014

(86) PCT No.: PCT/JP2014/078810
§ 371 (c)(1),
(2) Date: Apr. 20, 2017

(87) PCT Pub. No.: WO2016/067400
PCT Pub. Date: May 6, 2016

(65) Prior Publication Data

US 2017/0311684 A1 Nov. 2, 2017

(51) Int. Cl.

| | |
|---|---|
| ***B29D 5/02*** | (2006.01) |
| ***A44B 19/42*** | (2006.01) |
| ***A44B 19/24*** | (2006.01) |
| ***A44B 19/02*** | (2006.01) |
| ***A44B 19/06*** | (2006.01) |

(52) U.S. Cl.
CPC ..... *A44B 19/24* (2013.01); *A44B 19/02* (2013.01); *A44B 19/06* (2013.01); *A44B 19/42* (2013.01); *Y10T 24/25* (2015.01); *Y10T 24/2539* (2015.01)

(58) Field of Classification Search
CPC ..... A44B 19/02; A44B 19/24; Y10T 24/25; Y10T 24/2539
See application file for complete search history.

(56) References Cited

U.S. PATENT DOCUMENTS

| | | | |
|---|---|---|---|
| 6,602,953 | B1 | 8/2003 | Horio et al. |
| 2012/0097819 | A1 | 4/2012 | Avery et al. |

FOREIGN PATENT DOCUMENTS

| | | | |
|---|---|---|---|
| EP | 2591697 | A1 | 5/2013 |
| JP | H05-125256 | A1 | 5/1993 |
| JP | 08-165387 | A | 6/1996 |
| JP | 09-296053 | A | 11/1997 |
| JP | 2003-219903 | A | 8/2003 |

(Continued)

OTHER PUBLICATIONS

JP 2003-219903 English Translation Retrieved from https://www4.j-platpat.inpit.go.jp (Year: 2018).*

(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

Elements are made of a polyacetal resin, which can effectively improve the chain crosswise strength while maintaining wear resistance. Provided is a fastener element made of a polyacetal resin composition containing 5 to 30% by mass of reinforcing fibers each having an average fiber diameter of 5 to 15 μm and a numeric average fiber length of 150 to 500 μm.

8 Claims, 3 Drawing Sheets

(56) References Cited

FOREIGN PATENT DOCUMENTS

| | | | |
|---|---|---|---|
| JP | 2003-225102 | A | 8/2003 |
| JP | 2005-160667 | A | 6/2005 |
| JP | 2007-021023 | A | 2/2007 |
| WO | 01/032775 | A1 | 5/2001 |
| WO | 2012/004871 | A1 | 1/2012 |

OTHER PUBLICATIONS

JP 09-296053 A English Translation Retrieved from https://www4.j-platpat.inpit.go.jp (Year: 2018).*
WO 2012/004871 English Translation Retrieved from https://patentscope.wipo.int/search/en/search.jsf (Year: 2018).*
International Search Report, PCT Application No. PCT/JP2014/078810, dated Jan. 20, 2015.
International Preliminary Report on Patentability, PCT Application No. PCT/JP2014/078810, dated May 11, 2017.

* cited by examiner

FASTENER ELEMENT AND METHOD FOR PRODUCING SAME

This application is a national stage application of PCT/JP2014/078810, which is incorporated herein by reference.

TECHNICAL FIELD

The present invention relates to a fastener element and a method for producing the same. The present invention also relates to a fastener stringer comprising the fastener elements. The present invention also relates to a slide fastener comprising the fastener elements.

BACKGROUND ART

A slide fastener is a tool for opening and closing an article used in familiar daily necessities such as clothes, bags, shoes and miscellaneous goods, as well as industrial goods such as water storage tanks, fishing nets and space suites. The slide fastener is mainly comprised of three parts: a pair of long fastener tapes, a number of elements which are engaging portions of the fastener and are attached along one side edge of each tape, and a slider for controlling opening and closing of the fastener by engaging or separating the elements opposed to each other.

One of methods for attaching the elements to the fastener tape is injection molding of a synthetic resin to a core portion formed on one side edge of the fastener tape. A polyacetal (polyoxymethylene) resin is known as a material for forming the elements (Japanese Patent Application Public Disclosure (KOKAI) No. 2007-021023 A1). The polyacetal resin is an engineering resin having good balance between strength, elasticity, a creep property, impact resistance and a cyclic fatigue property, and is widely used in various mechanical parts as well as OA equipment.

In addition, Japanese Patent Application Public Disclosure (KOKAI) No. H05-125256 and WO 01/032775 disclose that the polyacetal resin can be used as a fastener material, and a glass fiber may be also added as a reinforcing agent or an inorganic filler. Further, WO 01/032775 discloses that the inorganic filler is preferably in the range of 0.5 to 100 parts by weight, and more preferably in the range of 2 to 80 parts by weight based on 100 parts by weight of the polyoxymethylene resin, and that the amount of less than 0.5 part by weight of the inorganic filler is insufficient for the reinforcing effect of the filler, and the amount of more than 100 parts leads to deterioration of the surface appearance and a decrease in molding formability and impact resistance, which are not preferred.

CITATION LIST

[Patent Document 1] Japanese Patent Application Public Disclosure (KOKAI) No. H05-125256 A1

[Patent Document 2] WO 01/032775

[Patent Document 3] Japanese Patent Application Public Disclosure (KOKAI) No. 2007-021023 A1

SUMMARY OF INVENTION

Problem to be Solved by the Invention

Conventionally, a slide fastener comprising elements produced by injection molding of a polyacetal resin has a disadvantage that the chain crosswise strength is weaker than that of a coil fastener. For this reason, articles for which strength is required, such as bags, have been needed to increase the size of the elements. In particular, a thinner element produced by injection molding of the polyacetal resin may lead to "opened legs" by deformation and opening of a tape clamping portion of the element when the chain crosswise strength is measured. Therefore, it is desirable to provide the elements made of the polyacetal resin with improved strength.

For this purpose, Patent Document 1 and Patent Document 2 disclose that the glass fibers can be incorporated in the fastener made of the polyacetal resin. However, there has remained a problem that even if the glass fibers are incorporated into a small part such as a fastener element, it is difficult to orient the glass fibers in a specific direction, which results in the lower chain crosswise strength than expected. In addition, there has been also a problem that a slider receiving friction from the element may wear out by the glass fibers incorporated into the elements.

The present invention has been made under the above circumstances. An object of the present invention is to provide elements made of a polyacetal resin, which can effectively improve the chain crosswise strength while maintaining wear resistance. Another object of the present invention is to provide a method for producing the elements made of the polyacetal resin. Further, another object of the present invention is to provide a fastener stringer comprising the elements according to the present invention. Furthermore, another object of the present invention is to provide a slide fastener comprising the elements according to the present invention.

Means for Solving the Problem

The present inventors have made intensive studies to solve the problems as stated above and found that an improved chain crosswise strength and wear resistance can be achieved by controlling an average fiber diameter and a numeric average fiber length of a reinforcing fiber within a specific range and incorporating the reinforcing fibers in an appropriate amount. Further, the present inventors have found that the chain crosswise strength and wear resistance can be further improved by controlling a fiber length distribution of the reinforcing fibers. The present invention has been completed based on the above findings.

In one aspect, the present invention relates to a fastener element comprising a polyacetal resin composition containing 5 to 30% by mass of reinforcing fibers each having an average fiber diameter of 5 to 15 μm and a numeric average fiber length of 150 to 500 μm.

In one embodiment of the fastener element according to the present invention, the reinforcing fibers have a fiber length distribution Lw/Ln of 1.0 to 2.0 in which Ln represents the numeric average fiber length and Lw represents a weight average fiber length.

In another embodiment of the fastener element according to the present invention, the reinforcing fibers each have the average fiber diameter of 6 to 13 μm, the numeric average fiber length of 200 to 350 μm, and the Lw/Ln of 1.1 to 1.8, and wherein the polyacetal resin composition contains 10 to 20% by mass of the reinforcing fibers.

In yet another embodiment of the fastener element according to the present invention, the fastener element has a thickness t of 2.6 mm or less, a lateral direction length l of 4.5 mm or less, and a longitudinal direction length m of 3.2 mm or less.

In yet another embodiment of the fastener element according to the present invention, the fastener element is produced by injection molding.

In another aspect, the present invention relates to a method for producing a fastener element comprising a polyacetal resin composition containing reinforcing fibers, the method comprising:

adjusting the content of the reinforcing fibers in the polyacetal resin composition by producing a masterbatch through a step of melt-knealing a first polyacetal resin composition containing the reinforcing fibers, and then mixing the masterbatch with a second polyacetal resin composition that does not contain the reinforcing fibers.

In yet another aspect, the present invention is a fastener stringer comprising the fastener elements according to the present invention.

In yet another aspect, the present invention is a fastener chain comprising the fastener elements according to the present invention, wherein the fastener chain has a pitch p between the elements of 3.5 mm or less, a chain width w of 6.3 mm or less, and a thickness t of 2.6 mm or less.

In yet another aspect, the present invention is a slide fastener comprising the fastener elements according to the present invention or the fastener chain according to the present invention.

In yet another aspect, the present invention is an article comprising the slide fastener according to the present invention.

Effects of the Invention

The present invention can remarkably improve chain crosswise strength of polyacetal fastener elements by reinforcing fibers, and also maintain wear resistance of the fastener elements. The present invention can be particularly effective in the elements with smaller pitch or thickness.

DETAILED DESCRIPTION OF THE PREFERRED EMBODIMENTS

Figure 1:
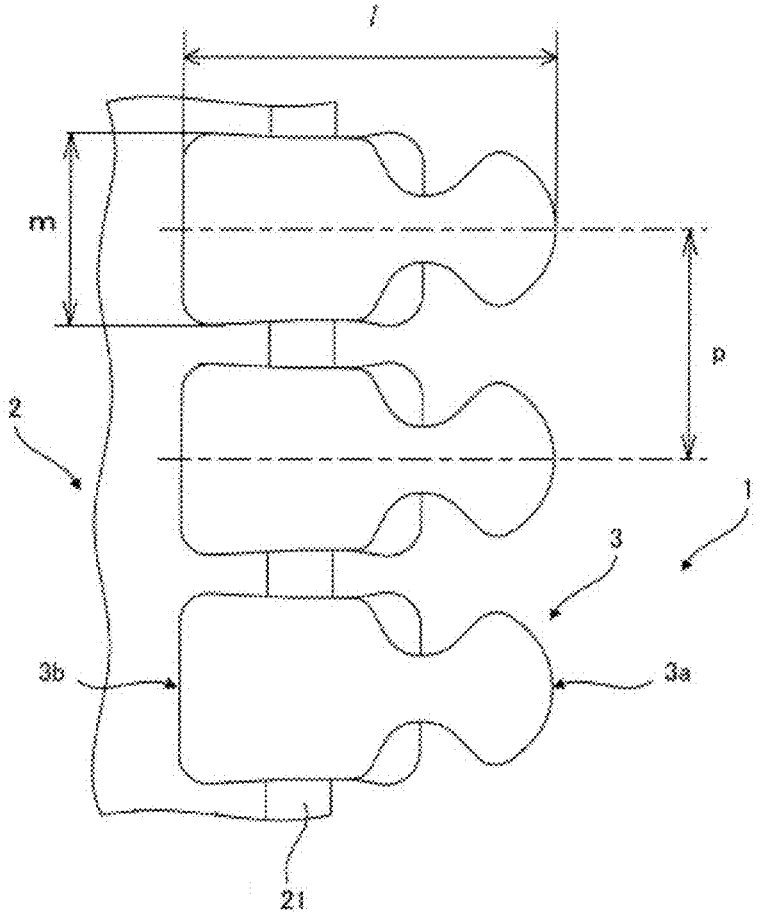
FIG. 1 is a partial front view of a fastener stringer comprising the elements according to the present invention.

The present invention is characterized in that fastener elements is produced by using a polyacetal resin composition containing an appropriate amount of reinforcing fibers having given shape properties (an average fiber diameter and a numeric average fiber length), which will be described in details below, including the preferred embodiments.

<1. Reinforcing Fiber>

(Materials)

The reinforcing fiber used in the present invention may include, but are not limited to, organic fibers such as carbon fibers and aramid fibers, as well as inorganic fibers such as glass fibers, ceramic fibers, metal fibers, mineral fibers, slug fibers, needle-like wollastonites, whiskers (for example, calcium titanate whiskers, calcium carbonate whiskers, aluminum borate whiskers). One or more selected from the glass fibers, the aramid fibers and the carbon fibers are preferably used, and the glass fibers are more preferably used, from the viewpoint that strength can be improved while maintaining fluidity exceeding a certain level. These materials may be used alone or two or more of these materials may be used in combination. The glass fibers that can be suitably used for the present invention include filamentous glass fibers obtained by melt-spinning glass such as E glass (Electrical glass), C glass (Chemical glass), A glass (Alkali glass), S glass (High strength glass), and akali-resistant glass. The glass monofilament that can be used in the present invention is preferably one which is obtained by melt-spinning the E glass into filament, in terms of the reinforcing effects.

(Content)

For the reinforcing fiber in the polyacetal resin composition for forming the element, a higher content of the reinforcing fiber tends to provide higher bending strength, and a lower content of the reinforcing fiber tends to provide higher tensile strength. Specifically, when the content of the reinforcing fiber is less than 5% by mass, improved effect of the bending strength cannot be obtained, so that legs of the elements are widened by the chain crosswise strength and the elements easily fall off. Therefore, the content of the reinforcing fiber in the polyacetal resin composition (i.e., in the element) should be 5% by mass or more, and preferably 10% by mass or more, and more preferably 13% by mass or more. On the other hand, when the content of the reinforcing fiber exceeds 30% by mass, the tensile strength of the element decreases and damage of the element is likely to occur. Therefore, the content of the reinforcing fiber in the polyacetal resin composition should be 30% by mass or less, and preferably 20% by mass or less, and more preferably 17% by mass or less.

(Average Fiber Diameter)

The average fiber diameter of the reinforcing fiber in the element also has a significant effect on the strength of the element and the wear resistance of the slide fastener. When the average fiber diameter of the reinforcing fiber in the element is less than 5 μm, sufficient reinforcing effects cannot be obtained and any damage of the element is likely to occur. Further, the larger the average fiber diameter of the reinforcing fiber is, the higher the wear resistance of the element is. Therefore, the average fiber diameter of the reinforcing fiber in the element should be 5 μm or more, and preferably 6 μm or more, and more preferably 8 μm or more. On the other hand, when the average fiber diameter of the reinforcing fiber exceeds 15 μm, the slider is easily worn out, and the wear resistance deteriorates and the reinforcing effect also decreases. Therefore, the average fiber diameter of the reinforcing fiber in the element should be 15 μm or less, and preferably 13 μm or less, and more preferably 11 μm or less.

In the present invention, the average fiber diameter of the reinforcing fiber in the element can be measured by the following method: the resin component is removed by firing the elements in an electric furnace maintained at 600° C. for 2 hours for the inorganic fibers, or at 500° C. for 5 hours for the organic fibers, and by means of a scanning electron microscope (SEM), the resulting fibers are then observed to randomly select 100 reinforcing fibers and measure a fiber diameter (diameter) at the central portion of the length of each of the selected 100 fibers at a magnification of 1000, and the arithmetic mean is calculated from the measured fiber diameters. Without firing, the fiber diameter of the reinforcing fiber in the resin may be measured in the same manner using a micro focus X-ray fluoroscopy/CT apparatus.

(Numeric Average Fiber Length)

The numeric average fiber length of the reinforcing fiber in the element also has a significant effect on the strength of the element and the wear resistance of the slide fastener. When the numeric average fiber length of the reinforcing fiber is less than 150 μm, sufficient reinforcing effects cannot be obtained and damage of the element is likely to occur. Further, the longer the numeric average fiber length of the reinforcing fiber is, the higher the wear resistance of the element row is. Therefore, the numeric average fiber length of the reinforcing fiber in the element should be 150 μm or more, and preferably 200 μm or more, and more preferably 250 μm or more. On the other hand, when the numeric average fiber length of the reinforcing fiber exceeds 500 μm, the slider is easily worn out, and the wear resistance deteriorates and the reinforcing effects also decrease. Therefore, the numeric average fiber length of the reinforcing fiber in the element should be 500 μm or less, and preferably 350 μm or less, and more preferably 300 μm or less.

In the present invention, the numeric average fiber length of the reinforcing fiber in the element (Ln) can be measured by the following method: the resin component is removed by firing the elements in an electric furnace maintained at 600° C. for 2 hours for the inorganic fibers, or at 500° C. for 5 hours for the organic fibers, and by means of a scanning electron microscope (SEM), the resulting fibers are then observed to randomly select 100 reinforcing fibers and measure the fiber length of each of the selected 100 fibers at a magnification of 50, and the numeric average fiber length is calculated from the observed results using the equation as stated below. Without firing, the fiber length of the reinforcing fiber in the resin may be measured using a micro focus X-ray fluoroscopy/CT apparatus.

$$Ln=\Sigma(Li\times Ni)/\Sigma Ni$$

Li: the fiber length of the reinforcing fiber

Ni: the number of the reinforcing fibers with fiber length Li (Lw/Ln)

The Lw/Ln represents a degree of variation in the fiber length of the reinforcing fibers, where Ln is the numeric average fiber length for the reinforcing fiber and $L_w$ is a weight average fiber length of the reinforcing fiber. In light of the definition, the Lw/Ln is 1.0 or more. The Lw/Ln of 1 means that all the reinforcing fibers contained in an element have the same fiber length, when these reinforcing fibers are made of the same material. A higher Lw/Ln value provides a higher reinforcing effect of the element, thereby resulting in further improvement effect of the crosswise strength. Therefore, the Lw/Ln is preferably 1.1 or more, and more preferably 1.2 or more, and even more preferably 1.3 or more. On the other hand, when the Lw/Ln is too high, on the contrary, the reinforcing effect decreases and the slider is easily worn out. Therefore, the Lw/Ln is preferably 2.0 or less, and more preferably 1.8 or less, and still more preferably 1.5 or less.

In the present invention, the weight average fiber length of the reinforcing fiber (Lw) can be measured by the following method: the resin component is removed by firing the elements in an electric furnace maintained at 600° C. for 2 hours for the inorganic fibers or at 500° C. for 5 hours for the organic fibers, and by means of a scanning electron microscope (SEM), the resulting fibers are then observed to randomly select 100 reinforcing fibers and measure the fiber length of each of the selected 100 fibers at a magnification of 50, and the weight average fiber length is calculated from the observed results using the equation as stated below. Without firing, the fiber length of the reinforcing fiber in the resin may be measured using a micro focus X-ray fluoroscopy/CT apparatus.

$$\begin{aligned} Lw &= \Sigma(Wi\times Li)/\Sigma Wi \\ &= \Sigma(\pi Ri^2\times Li\times\rho\times Ni\times Li)/\Sigma(\pi Ri^2\times Li\times\rho\times Ni) \\ &= \Sigma(Ri^2\times Li^2\times Ni)/\Sigma(Ri^2\times Li\times Ni) \end{aligned}$$

Li: the fiber length of the reinforcing fibers

Ni: the number of the reinforcing fibers with fiber length Li

Wi: the weight of the reinforcing fibers

Ri: the fiber diameter at the central portion of the length of the reinforcing fiber P: the density of the reinforcing fiber A surface of the reinforcing fiber is usually covered with a sizing agent. Covering the reinforcing fiber with the sizing agent can provide advantages that adhesion to the resin is increased and strength is further improved. The sizing agent includes, but is not limited to, urethane-based coupling agents, polyester-based coupling agents, acrylic-based coupling agents, epoxy-based coupling agents, and any other coupling agents. The urethane-based coupling agents, acrylic-based coupling agents and silane-based coupling agents are more preferred.

The coupling agents include silane-based coupling agents, titanate-based coupling agents, aluminum-based coupling agents, chromium-based coupling agents, zirconium-based coupling agents, and borane-based coupling agents, and may be preferably the silane-based coupling agents or the titanate-based coupling agents, and may be more preferably silane-based coupling agents.

The silane-based coupling agents include triethoxysilane, viny-ltris (β-methoxyethoxy) silane, γ-methacryloxypropyltrimethoxysilane, γ-glycidoxypropyltrimethoxysilane, β-(3,4-epoxycyclohexyl)ethyltrimethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, and γ-chloropropyltrimethoxysilane, and may be preferably aminosilanes such as γ-aminopropyltriethoxysilane and N-β-(aminoethyl)-γ-aminopropyltrimethoxysilane.

<2. Polyacetal Resin>

The polyacetal resin is a polymer compound whose main structural unit is an oxymethylene group (—$CH_2O$—). The polyacetal resin that can be used in the present invention includes, but are not limited to, polyacetal homopolymers and polyacetal copolymers. Representative examples of the polyacetal homopolymers include, but not limited to, polyacetal homopolymers obtained by homopolymerizing a formaldehyde monomer or a cyclic oligomer of formaldehyde. Representative examples of the polyacetal copolymers include, but not limited to, polyacetal copolymers obtained by copolymerizing a formaldehyde monomer or a cyclic oligomer of formaldehyde with a cyclic ether and/or a cyclic formal. The cyclic oligomer of formaldehyde includes a trimer (trioxane) and a tetramer (tetraoxane) of formaldehyde. The cyclic ethers and the cyclic formals include ethylene oxide, propylene oxide, epichlorohydrin, and 1,3-dioxolane, and cyclic formals of glycols and diglycols such as 1,4-butanediol formal.

Further, the polyacetal copolymers may also include branched polyacetal copolymers obtained by copolymerizing monofunctional glycidyl ethers and polyacetal copolymers having a crosslinked structure obtained by copolymerizing polyfunctional glycidyl ethers.

Further, the polyacetal homopolymers may also include compounds having a functional group(s) such as a hydroxyl group(s) at both ends or one end, for example, polyacetal homopolymers having a block component obtained by polymerizing a formaldehyde monomer or a cyclic oligomer of formaldehyde in the presence of a polyalkylene glycol. Furthermore, the polyacetal copolymers may also include compounds having a functional group(s) such as a hydroxyl group(s) at both end or one end, for example, polyacetal copolymers having a block component obtained by copolymerizing a formaldehyde monomer or a cyclic oligomer of formaldehyde with a cyclic ether and/or a cyclic formal in the presence of a hydrogenated polybutadiene glycol.

The present invention may use any of the polyacetal homopolymers and the polyacetal copolymers, although the above lists are not exhaustive. These polyacetal resins may be used alone or two or more of these polyacetal resins may be used in combination.

<3. Other Additives>

In the polyacetal resin composition according to the present invention, the total content of the polyacetal resin and the reinforcing fiber is typically 90% by mass or more, and more typically 95% by mass or more. This total content may be 98% by mass or more, and furthermore 100% by mass. On the other hand, the polyacetal resin composition may contain commonly used additives such as dyes, pigments, heat stabilizers, weathering agents, and hydrolysis resistant agents, for example in a total amount of 10% by mass or less, and typically 5% by mass or less, and more typically 2% by mass or less.

<4. Element>

The polyacetal resin composition according to the present invention can be produced by melt-kneading each of the above-mentioned constituent components using an apparatus such as a single screw kneading extruder, a twin screw kneading extruder, and a kneader. After melt-kneading, the element can be produced by any conventional molding means, for example injection molding. In general, a row of the elements is injection-molded on one side edge of a fastener tape while at the same time fixing the row of the elements to the fastener tape.

Since the reinforcing fibers are fractured and shortened during the melt-kneading, it is necessary to control a screw rotation speed, a screw configuration, a kneading temperature and the like, so that the reinforcing fibers have the above-mentioned shape properties when finally formed into the elements. In particular, to narrow the fiber length distribution of the reinforcing fiber (to reduce the value of Lw/Ln), a masterbatch of the polyacetal resin composition containing high concentration of reinforcing fibers can be prepared, to which a colored or colorless polyacetal resin that does not contain the reinforcing fibers, and optionally additives may be added. If the masterbatch is not prepared, the fiber length of the reinforcing fibers will tend to widely vary. The concentration of the reinforcing fiber in the masterbatch may be, for example, 40 to 80% by mass, and typically 45 to 65% by mass. The masterbatch can be prepared by adding predetermined concentration of the reinforcing fibers to the polyacetal resin and kneading the melt, and the kneaded melt may be cooled to solidify it. The use of the masterbatch can provide advantages that the control of the fiber length distribution of the reinforcing fibers can be improved and the adjustment of the reinforcing fiber concentration and the production of the colored pellets can be facilitated. That is, by blending the masterbatch with predetermined kinds of the colored or colorless polyacetal resins that do not contain the reinforcing fibers, colored resins containing the reinforcing fibers, which have several hundred colors, can be easily produced, which will result in improved productivity.

Although the invention is not intended to be limited by any theory, the mechanism of equalizing the fiber length by using the masterbatch will be described. The masterbatch can produce a strong kneading effect, because the high concentration of reinforcing fibers are incorporated and dispersed in the resin, and a shearing force among the reinforcing fibers strongly acts, in addition to a shearing force by the screw. Further, since the shearing force among the reinforcing fibers functions more to fracture the longer fibers than the shorter fibers, the variation in the fiber length can be reduced.

A configuration example of a twin-screw kneading extruder that can be used in the present invention will be described. The twin-screw kneading extruder generally includes a screw structure having a melting zone and a kneading zone, and in which a motor-driven screw shaft is composed of a combination of flight screw and kneading element called kneading disc.

Both of the melting zone and the kneading zone preferably include the kneading discs. Including the kneading discs allows the polyacetal resin to be melt and the reinforcing fibers to be finely dispersed. The kneading discs produce a high kneading capability by alternately arranging the discs relative to each other. The kneading discs have a forward feeding type, a non-feeding type, and a reverse feeding type, and the forward feeding type kneading discs typically have from 2 to 10 blades and a twist angle of the blades of 10 to 60 degrees, and a length in the range of 0.3 to 2.0 times of a screw long diameter. The non-feeding type kneading discs typically have from 2 to 10 blades, a twist angle of the blades of 70 to 110 degrees, and a length in the range of 0.3 to 2.0 times of a screw long diameter. The reverse feeding type kneading discs typically have from 2 to 10 blades, a twist angle of the blades of 10 to 60 degrees, and a length in the range of 0.3 to 2.0 of a screw long diameter.

A cylinder of the extruder can be composed of a plurality of blocks, and the screw configuration can be changed in each block. The number and type (forward feeding, non-feeding, and reverse feeding) of the kneading discs, and the number and position of the cylinder blocks composed of the kneading discs can be appropriately determined depending on the purpose. Also, the number, type (forward feeding and reverse feeding) and position of the cylinder blocks composed of the flight screws can be appropriately determined depending on the purpose. Functions such as a hopper, a vent, and a side feeder can also be added according to the role of each block.

The extruder preferably has a degassing vent. Degassing of formaldehyde generated by a thermal history and the like from the vent can reduce an amount of formaldehyde emitted from the polyacetal resin. The degassing vent is preferably positioned after kneading in the melting zone and the kneading zone by the kneading discs, and the degassing is preferably performed under a reduced pressure of −0.06 to −0.1 MPa. The degassing vent and/or an open vent may be provided between the melting zone and the kneading zone depending on the length of the barrel. The vent provided between the melting zone and the kneading zone may be an open vent for degassing the entrained air generated by side-feeding of the reinforcing fibers, or for confirming the molten state.

Figure 5:
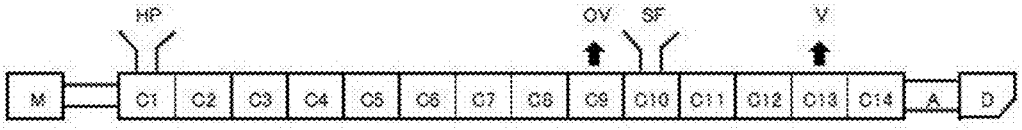
FIG. 5 is a configuration example of a twin-screw kneading extruder.

Referring to FIG. 5, the polyacetal resin is fed into the cylinder from a hopper (HP) port on the extruder and melted in the melting zone (C1 to C9). The open vent is installed in the final block (C9) of the melting zone. Next, the reinforcing fibers are supplied from a side feed (SF) port, and kneaded in the kneading zone (C10 to C14), and further the degassing is carried out from a vent (V) port, and the mixture can be continuously extruded from die (D) via an adapter (A) detachably connected between the extruder and the die. In the present invention, the hopper (HP) port is a feeding port located at the base of the screw, and the side feed (SF) port is a feeding port located between the hopper port and the dies. The reinforcing fibers are preferably supplied from the side feed (SF) port for maintaining the reinforcing fiber at a certain length and reducing any abrasion of the manufacturing machine, and the like.

A processing temperature for melt-kneading is preferably 180 to 240° C., and inert gas replacement is also preferably carried out for maintaining qualities and work environments.

Figure 2:
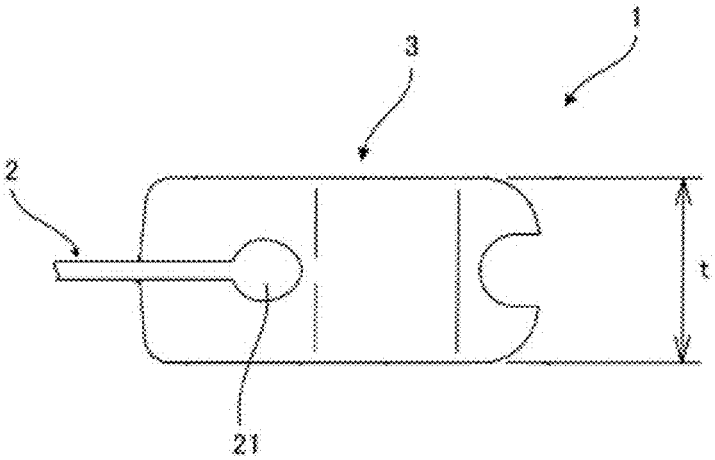
FIG. 2 is a partial side view of the fastener stringer comprising the elements according to the present invention.
Figure 3:
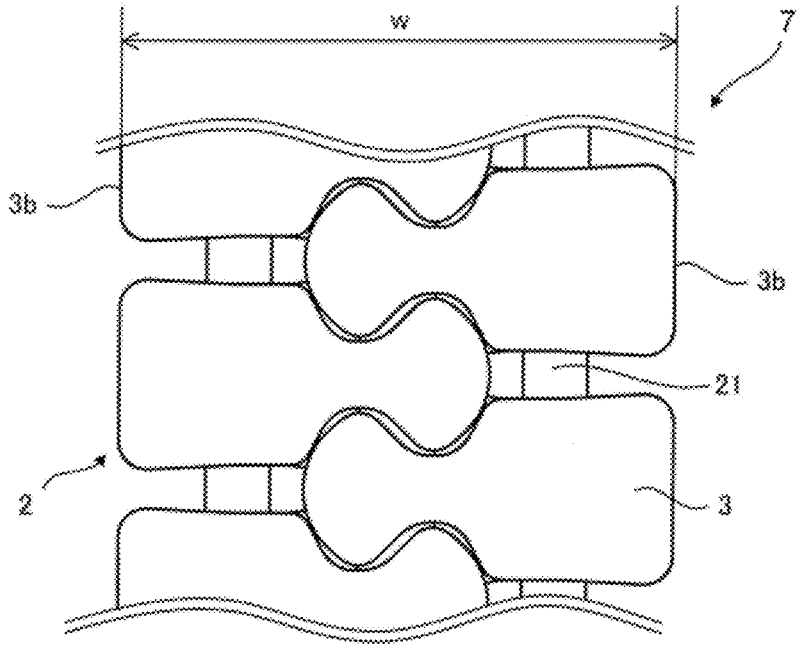
FIG. 3 is a partial front view of a fastener chain comprising the elements according to the present invention.

FIGS. 1 and 2 show a partial schematic view of a fastener stringer 1 in which a row of elements 3 for the slide fastener according to the present invention is clamped and fixed to a core portion 21 provided on one side edge of a fastener tape 2 by injection molding. As shown in FIG. 1, a pitch p of the elements 3 represents the length between the center lines of the adjacent elements 3. A lateral direction length l of the element 3 represents the maximum distance in the direction perpendicular to the arrangement direction of the elements and parallel to the surface of the fastener tape (in the present invention, this direction is referred to as a "lateral direction"). In other words, it represents the distance from a tip 3*a* of a head portion engaging with the opposing element to a tip 3*b* of a leg portion located on the opposite side from the head portion and fixed to the tape. A longitudinal direction length m of the element 3 represents the maximum distance in the direction parallel to the arrangement direction of the elements (in the present invention, this direction is referred to as a "longitudinal direction"). As shown in FIG. 2, a thickness t of the element 3 represents the maximum distance in the direction parallel to the front and back direction of the fastener tape. In addition, FIG. 3 shows a partial front view of a fastener chain comprised by engaging the elements of a pair of fastener stringers. A chain width w represents the maximum distance between the tips 3*b* of the leg portions of the elements in the lateral direction when the opposing elements are engaged with each other.

Although the size of the element 3 for the slide fastener according to the present invention is not particularly limited, the present invention can achieve reinforcing effects even on a small element in which the reinforcing fibers are hardly oriented in a given direction so that the reinforcing effects of the reinforcing fibers are hardly produced. When the size of such a small element is expressed by the lateral direction length l, the longitudinal direction length m and the thickness t, the lateral direction length l is generally 4.5 mm or less, and for a smaller element it is 4.1 mm or less, and for an even smaller element it is 3.6 mm or less, and for example 3.2 to 4.5 mm. The longitudinal direction length m is generally 3.2 mm or less, and for a smaller element it is 2.7 mm or less, and for an even smaller element it is 2.2 mm or less, and for example 1.9 to 3.2 mm. The thickness t is generally 2.6 mm or less, and for a smaller element it is 2.4 mm or less, and for an even smaller element it is 2.2 mm or less, and for example 1.5 to 2.6 mm.

Further, when the size of the element 3 is expressed by the pitch p, the pitch p is generally 3.5 mm or less, and for a smaller element it is 3.0 mm or less, and for an even smaller element it is 2.5 mm or less, and for example 2.2 to 3.5 mm. In addition, when the size of the element 3 is expressed by the chain width w, the chain width w is generally 6.3 mm or less, and for a smaller element it is 5.9 mm or less, and for an even smaller element it is 5.5 mm or less, and for example 4.5 to 6.3 mm.

Figure 4:
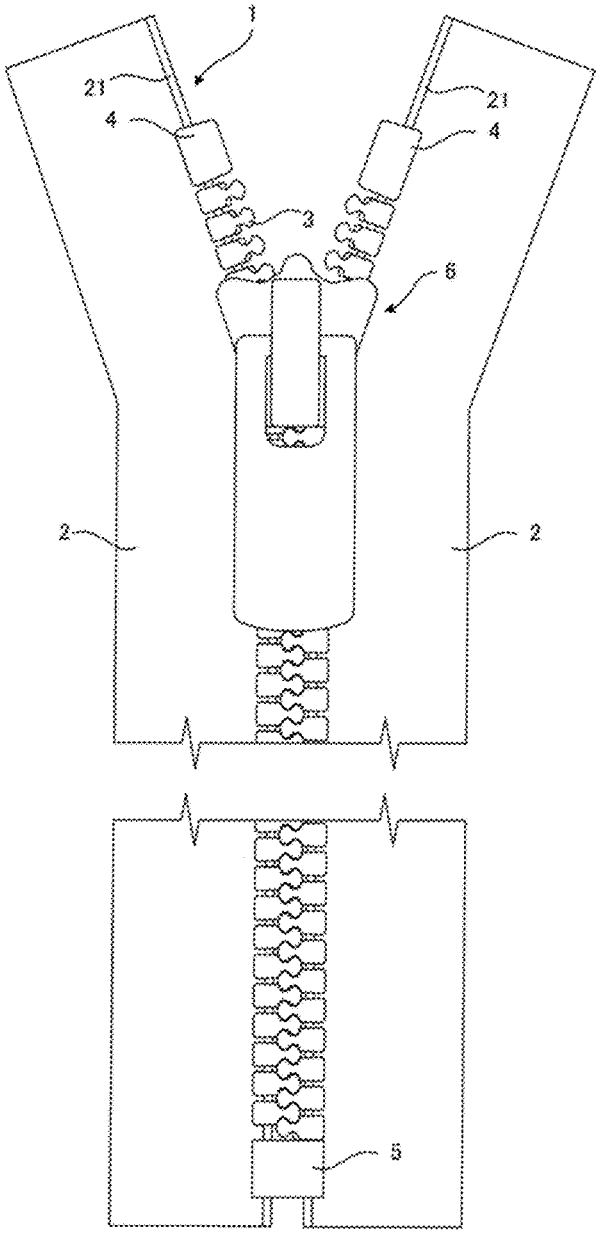
FIG. 4 is a front view of a slide fastener comprising the elements according to the present invention.

FIG. 4 shows a schematic view of a slide fastener comprising the elements according to the present invention, and the slide fastener includes a pair of the fastener tapes 2 having a core portion 21 formed on one side edge of the fastener tapes, a row of the elements 3 attached to the core portion 21 of the fastener tape 2 at a predetermined space, a upper stopper 4 and a lower stopper 5 fixed to the core portion 21 of the fastener tapes 2 at the upper end and the lower end of the row of the elements 3, and a slider 6 arranged between a pair of the rows of the elements 3 opposed to each other and slidable in the up and down direction for engaging and disengaging the elements 3.

One in which the row of the elements 3 has been attached along one side edge of one fastener tape 2 is referred to as a fastener stringer, and one in which the rows of the elements 3 of a pair of the fastener stringers have been engaged with each other is referred to as a fastener chain. It is noted that the lower stopper 5 may be an openable, closable and fittingly insertable tool provided with an insert pin, a box pin and a box body, so that the pair of slide fastener chains can be separated by separating operation of the slider.

The insulating materials used in the fastener tape 2 are not limited, but may be natural resins or synthetic resins. Generally, fibers made of these materials are woven or knitted to form a fastener tape. Typically, polyesters, polyamides, polypropylenes, acrylic resins and the like can be used as the materials for the fastener tape 2. Among them, polyester tapes are preferred in terms of good chain crosswise strength.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

EXAMPLES

Hereinafter, Examples of the present invention are illustrated, but they are provided for better understanding of the present invention and its advantages, and are not intended to limit the present invention.

(Production of GF Masterbatches G-1 to 16 and G-17)

Commercially available glass fibers each having a fiber length of 3 mm with a sizing agent adhered to glass monofilaments made of E glass were prepared. The prepared glass fibers have various average fiber diameters shown in Table 1 according to the masterbatch number. The melt kneading was then carried out at a ratio of 50 parts by mass of the glass fiber (GF) per 50 parts by mass of a polyacetal resin using a twin-screw kneading extruder having a screw diameter of 45 mm at a melt-kneading temperature of 200° C. and a screw rotation speed of 150 rpm, and the melt was then extruded into strands and pelletized with a pelletizer to produce GF masterbatches G-1 to 7 (products each having a concentration of 50%) containing the glass fibers having various average fiber diameters and numeric average fiber length shown in Table 1. The average fiber diameter and numeric average fiber length of the glass fiber in each masterbatch were measured by SEM observation as described below. The fiber diameter of the glass fiber does not change throughout the course from the beginning to the completion of the element.

GF masterbatches G-8 to 13 having different numeric average fiber length were produced by adjusting the screw rotation speed and the screw configuration of the twin-screw kneading extruder used for producing the G-1. The fiber length tends to decrease as the screw rotation speed is higher, and the Lw/Ln tends to decrease as the kneading temperature is higher. Specifically, the screw configuration was adjusted by changing the type (forward feeding or reverse feeding) of the kneading discs after the side feeding of the glass fibers. Much use of the forwarding kneading discs tend to decrease the degree of kneading, so that the fiber length of the glass fibers is longer, and the Lw/Ln is larger. On the other hand, much use of the reverse feeding kneading discs tend to increase the degree of kneading, so that the fiber length of the glass fibers is shorter, and the Lw/Ln is smaller.

GF masterbatches G-14 to 16 having different fiber length distributions were produced by changing the screw rotation speed and the kneading temperature of the twin-screw kneading extruder used for producing the G-1. The Lw/Ln tends to be larger as the kneading temperature is higher.

Further, 15 parts by mass of the same glass fiber as G-1, 20 parts by mass of a blue-colored polyacetal resin and 65 parts by mass of colorless polyacetal resin were melt-kneaded by a twin-screw kneading extruder having a screw diameter of 45 mm at a kneading temperature of 200° C. and a screw rotation speed of 200 rpm and then extruded into strands, and pelletized with a pelletizer to produce G-17 (a product having a concentration of 15%). G-17 itself is a polyacetal resin composition for forming the element, and is not a masterbatch.

TABLE 1

| GF Master No. | Average Fiber Diameter μm | Numeric Average Fiber Length μm |
|---|---|---|
| G-1 | 10.2 | 353 |
| G-2 | 3.1 | 354 |
| G-3 | 5.1 | 356 |
| G-4 | 6.1 | 352 |
| G-5 | 13.0 | 357 |
| G-6 | 15.1 | 358 |
| G-7 | 18.2 | 352 |
| G-8 | 10.2 | 227 |
| G-9 | 10.2 | 250 |
| G-10 | 10.2 | 303 |
| G-11 | 10.2 | 453 |
| G-12 | 10.2 | 602 |
| G-13 | 10.2 | 658 |
| G-14 | 10.2 | 351 |
| G-15 | 10.2 | 350 |
| G-16 | 10.2 | 357 |
| G-17 | 10.2 | 711 |

(Production of Fastener Chain Samples 1 to 24)

The GF masterbatch, the blue-colored polyacetal resin (colored POM), and the colorless polyacetal resin (colorless POM) were blended at the proportions shown in Table 2 to produce resin compositions of V-1 to 24, and subsequently by using a chain injection device, the row of the elements having the shape as shown in FIG. 1 was injection-molded on a core portion provided on one side edge of a fastener tape to produce a fastener stringer, and then a pair of the fastener stringers was engaged to form fastener chain samples 1 to 24. These chains had a thickness (t) of 1.9 mm, a chain width (w) of 5.7 mm, and an element pitch (p) of 2.4 mm.

TABLE 2

| Resin Composition for Injection Molding No. | GF Master No. | Content of GF Master (parts by mass) | Content of Colored POM (parts by mass) | Content of Colorless POM (parts by mass) |
|---|---|---|---|---|
| V-1 | G-1 | 0 | 20 | 80 |
| V-2 | G-1 | 6 | 20 | 74 |
| V-3 | G-1 | 10 | 20 | 70 |
| V-4 | G-1 | 20 | 20 | 60 |
| V-5 | G-1 | 30 | 20 | 50 |
| V-6 | G-1 | 40 | 20 | 40 |
| V-7 | G-1 | 60 | 20 | 20 |
| V-8 | G-1 | 66 | 20 | 14 |
| V-9 | G-2 | 30 | 20 | 50 |
| V-10 | G-3 | 30 | 20 | 50 |
| V-11 | G-4 | 30 | 20 | 50 |
| V-12 | G-5 | 30 | 20 | 50 |
| V-13 | G-6 | 30 | 20 | 50 |
| V-14 | G-7 | 30 | 20 | 50 |
| V-15 | G-8 | 30 | 20 | 50 |
| V-16 | G-9 | 30 | 20 | 50 |
| V-17 | G-10 | 30 | 20 | 50 |
| V-18 | G-11 | 30 | 20 | 50 |
| V-19 | G-12 | 30 | 20 | 50 |
| V-20 | G-13 | 30 | 20 | 50 |
| V-21 | G-14 | 30 | 20 | 50 |
| V-22 | G-15 | 30 | 20 | 50 |
| V-23 | G-16 | 30 | 20 | 50 |
| V-24 | G-17 | 100 | 0 | 0 |

The produced fastener chains were evaluated according to the following procedures. The results are shown in Table 3.

(Average Fiber Diameter)

Ten elements cut from the fastener chain were placed in an alumina crucible and fired in an electric furnace maintained at 600° C. for 2 hours, and the resulting residue was observed with a scanning electron microscope (SEM). The fiber diameter at the central portion of each length of 100 grass fibers randomly selected was measured at a magnification of 1000, and the arithmetic mean thereof was regarded as the average fiber diameter.

(Numeric Average Fiber Length and Weight Average Fiber Length)

Elements cut from the GF masterbatch or the fastener chain were fired and observed with SEM in the same manner as described above. Using the SEM images at a magnification of 50, the fiber diameter and the fiber length at the central portion of each length of 100 glass fibers randomly selected were measured. The numeric average fiber length Ln and the weight average fiber length Lw were calculated based on the above-mentioned equations.

(Chain Crosswise Strength)

The chain crosswise strength was measured according to JIS S 3015: 2007.

(Fastener Reciprocating Opening and Closing Test)

The reciprocating opening and closing test was performed 1000 times for the fastener according to JIS S 3015: 2007. A slider made of a nylon resin (containing 70% by mass of GF) was used. The slider was removed from the tested fastener, and the wear states on the surfaces of the elements and the inside of the slider were observed with an optical microscope, and the results were classified into levels as described below.

◎ (double circle): No wear mark was observed;

○ (single circle): Slight wear marks were observed;

Δ (triangle): Wear marks and wear stripes of 1 to 3 were observed;

x (single x): Wear marks and wear stripes of 4 to 10 were observed;

x x (double x): Wear marks and wear stripes of 11 or more were observed.

TABLE 3

| | Resin Composition for Injection Molding No. | GF Content mass % | Average Fiber Diameter μm | Numeric Average Fiber Length μm | Lw/Ln — | Remarks | Chain Crosswise Strength N | Damage Status | Fastener Durability Test Elements | Fastener Durability Test Slider |
|---|---|---|---|---|---|---|---|---|---|---|
| Sample-1 | V-1 | — | — | — | — | Comparative Example | 203 | Fallen | XX | ◎ |
| Sample-2 | V-2 | 3.0 | 10.2 | 251 | 1.29 | Comparative Example | 225 | Fallen | X | ◎ |
| Sample-3 | V-3 | 5.0 | 10.2 | 259 | 1.32 | Example | 341 | Broken | Δ | ◎ |
| Sample-4 | V-4 | 10.0 | 10.2 | 271 | 1.30 | Example | 365 | Broken | ○ | ◎ |
| Sample-5 | V-5 | 15.0 | 10.2 | 270 | 1.39 | Example | 397 | Broken | ◎ | ◎ |
| Sample-6 | V-6 | 20.0 | 10.2 | 266 | 1.37 | Example | 372 | Broken | ◎ | ○ |
| Sample-7 | V-7 | 30.0 | 10.2 | 257 | 1.36 | Example | 352 | Broken | ◎ | Δ |
| Sample-8 | V-8 | 33.0 | 10.2 | 289 | 1.36 | Comparative Example | 233 | Broken | ◎ | X |
| Sample-9 | V-9 | 15.0 | 3.1 | 266 | 1.37 | Comparative Example | 227 | Broken | ○ | ◎ |
| Sample-10 | V-10 | 15.0 | 5.1 | 256 | 1.38 | Example | 364 | Broken | ○ | ◎ |
| Sample-11 | V-11 | 15.0 | 6.1 | 285 | 1.37 | Example | 376 | Broken | ○ | ◎ |
| Sample-12 | V-12 | 15.0 | 13.0 | 259 | 1.33 | Example | 373 | Broken | ◎ | ○ |
| Sample-13 | V-13 | 15.0 | 14.9 | 279 | 1.39 | Example | 364 | Broken | ◎ | Δ |
| Sample-14 | V-14 | 15.0 | 18.2 | 275 | 1.35 | Comparative Example | 341 | Broken | ◎ | X |
| Sample-15 | V-15 | 15.0 | 10.2 | 121 | 1.26 | Comparative Example | 230 | Broken | ○ | ◎ |
| Sample-16 | V-16 | 15.0 | 10.2 | 152 | 1.29 | Example | 353 | Broken | ○ | ◎ |
| Sample-17 | V-17 | 15.0 | 10.2 | 209 | 1.39 | Example | 373 | Broken | ◎ | ◎ |
| Sample-18 | V-18 | 15.0 | 10.2 | 346 | 1.41 | Example | 371 | Broken | ◎ | ○ |
| Sample-19 | V-19 | 15.0 | 10.2 | 495 | 1.32 | Example | 364 | Broken | ◎ | Δ |
| Sample-20 | V-20 | 15.0 | 10.2 | 558 | 1.32 | Comparative Example | 333 | Broken | ◎ | X |
| Sample-21 | V-21 | 15.0 | 10.2 | 257 | 1.11 | Example | 372 | Broken | ◎ | ◎ |
| Sample-22 | V-22 | 15.0 | 10.2 | 261 | 1.98 | Example | 370 | Broken | ◎ | ○ |
| Sample-23 | V-23 | 15.0 | 10.2 | 298 | 2.03 | Example | 372 | Broken | ○ | Δ |
| Sample-24 | V-24 | 15.0 | 10.2 | 608 | 2.58 | Comparative Example | 348 | Broken | ○ | X |

(Discussion)

Sample-1 showed the lower chain crosswise strength and the higher level of wearing of the chain in the durability test, because Sample 1 did not contain the glass fibers.

Sample-2 to sample-8 had the appropriate values for the average fiber diameter, the numeric average fiber length and the Lw/Ln, while they had the varied contents of the glass fibers. Sample-2 had insufficient improvement of the chain crosswise strength because the content of the glass fiber was too low. The elements were also seriously worn out. Sample-3 to sample-7 are Inventive Examples, which had the higher chain crosswise strength and the improved durability because of their appropriate values for the content of glass fibers, the average fiber diameter, the numeric average fiber length and the Lw/Ln. In particular, Sample-5 containing 15% by mass of the glass fibers showed not only the highest chain crosswise strength, but also the outstanding durability. Sample-8 showed insufficient improvement of the chain crosswise strength because the content was excessive, although it contained the glass fibers. Further, the slider was worn out in the durability test.

Sample-9 to sample-14 had the appropriate values for the content of glass fibers, the numeric average fiber length, and the Lw/Ln, while they had the varied average fiber diameters. Sample-9 showed insufficient improvement of the chain crosswise strength because the average fiber diameter was too short. Sample-10 to sample-13 are Inventive Examples, which had the higher chain crosswise strength and the improved durability because they had the appropriate values for the content of glass fibers, the average fiber diameter, the numeric average fiber length and the Lw/Ln. In particular, sample-11 and sample-12 having the fiber diameter in the range of 6 to 13 μm showed good results. In sample-14, the slider was worn out in the durability test because the average fiber diameter was too large.

Sample-15 to sample-20 had the appropriate values for the content of glass fibers, the average fiber diameter, and the Lw/Ln, while they had the varied numeric average fiber length. Sample-15 showed insufficient improvement of the chain crosswise strength because the numeric average fiber length was too short. Sample-16 to sample-19 are Inventive Examples, which had the higher chain crosswise strength and the improved durability because they had the appropriate values for the content of glass fibers, the average fiber diameter, the numeric average fiber length and the Lw/Ln. In particular, sample-17 and sample-18 having the fiber length in the range of 200 to 350 μm showed good results. In sample-20, the slider was worn out in the durability test because the numeric average fiber length was too long.

Sample-21 to sample-23 are all Inventive Examples having the appropriate values for the content of glass fibers, the numeric average fiber length and the average fiber diameter, while they had varied Lw/Ln values to verify the effects of Lw/Ln. Among them, sample-21 having the Lw/Ln in the range of 1.1 to 1.8 showed the best results. In sample-23 having the Lw/Ln of more than 2, the slider was easily worn out, because sample-23 had the broader distribution of the glass fiber length and the larger proportion of the longer fibers.

Sample 24 used the resin composition produced by melt-kneading the glass fiber and the polyacetal resin without preparing the masterbatch. The slider was worn out in the durability test because the numeric average fiber length was too long and the Lw/Ln was too large.

DESCRIPTION OF REFERENCE NUMERALS

1 fastener stringer
2 fastener tape
21 core portion
3 elements
4 upper stopper
5 lower stopper
6 slider
7 fastener chain
M extruder motor
C1-14 cylinder block
A adaptor
D dyes
HP hopper
SF side feeder
OV open vent
V degassing vent

What is claimed is:

1. A fastener element made of a polyacetal resin composition containing 13 to 17% by mass of reinforcing fibers having an average fiber diameter of 8-11 μm and a numeric average fiber length of 200 to 270 μm, wherein the reinforcing fibers have a fiber length distribution Lw/Ln of 1.0 to 1.5 in which Ln represents the numeric average fiber length and Lw represents a weight average fiber length.

2. The fastener element according to claim 1, wherein the fastener element has a thickness t of 2.6 mm or less, a lateral direction length l of 4.5 mm or less, and a longitudinal direction length m of 3.2 mm or less.

3. The fastener element according to claim 1, wherein the fastener element is produced by injection molding.

4. A method for producing the fastener element according to claim 1, the method comprising:

adjusting the content of the reinforcing fibers in the polyacetal resin composition by producing a masterbatch through a step of melt-kneading a first polyacetal resin composition containing the reinforcing fibers, and then mixing the masterbatch with a second polyacetal resin composition that does not contain the reinforcing fibers.

5. A fastener stringer comprising the fastener elements according to claim 1.

6. A fastener chain comprising the fastener elements according to claim 1, wherein the fastener chain has a pitch p between the elements of 3.5 mm or less, a chain width w of 6.3 mm or less, and a thickness t of 2.6 mm or less.

7. A slide fastener comprising the fastener elements according to claim 1 or the fastener chain according to claim 6.

8. An article comprising the slide fastener according to claim 7.

* * * * *